US007699039B2

(12) United States Patent
Carlsson et al.

(10) Patent No.: US 7,699,039 B2
(45) Date of Patent: Apr. 20, 2010

(54) START SAFETY IGNITION SYSTEM

(75) Inventors: Bo Carlsson, Alingsås (SE); Mikael Larsson, Jönköping (SE); Lars Andersson, Göteborg (SE); Tore Aronsson, Mölndal (SE)

(73) Assignee: Husqvarna AB, Jönköping (SE)

( * ) Notice: Subject to any disclaimer, the term of this patent is extended or adjusted under 35 U.S.C. 154(b) by 0 days.

(21) Appl. No.: 11/968,191

(22) Filed: Jan. 1, 2008

(65) Prior Publication Data

US 2008/0223339 A1 Sep. 18, 2008

Related U.S. Application Data

(63) Continuation-in-part of application No. PCT/SE2005/001100, filed on Jul. 1, 2005, now abandoned.

(51) Int. Cl.
*F02P 5/00* (2006.01)
*F02P 9/00* (2006.01)

(52) U.S. Cl. ..... 123/406.53; 123/334

(58) Field of Classification Search ..... 123/319, 123/406.54, 406.53; 701/110, 115
See application file for complete search history.

(56) References Cited

U.S. PATENT DOCUMENTS 4,336,778 A * 6/1982 Howard ..... 123/334
4,553,517 A * 11/1985 Andreasson ..... 123/329
4,610,231 A * 9/1986 Nakata et al. ..... 123/406.53
4,630,590 A * 12/1986 Kondo et al. ..... 123/406.75
4,918,921 A * 4/1990 Leigh-Monstevens et al. . 60/545
5,050,553 A * 9/1991 Erhard ..... 123/406.54
6,513,494 B2 * 2/2003 Kawasaki et al. ..... 123/406.12
7,040,282 B2 * 5/2006 Andersson et al. ..... 123/335
7,171,942 B2 * 2/2007 Nickel ..... 123/335

FOREIGN PATENT DOCUMENTS

EP 1496249 A1 1/2005

OTHER PUBLICATIONS

International Application No. SE2005/001100 Publication WO 2007/004936-A1, including International Search Report.

* cited by examiner

*Primary Examiner*—Stephen K Cronin
*Assistant Examiner*—David Hamaoui
(74) *Attorney, Agent, or Firm*—Novak Druce & Quigg LLP

(57) ABSTRACT

A method for controlling an ignition system of an internal combustion engine having a primary firing pulse generator for charging a capacitor. An electronic switch is included for discharging the capacitor via an ignition coil to generate an ignition voltage. A microcomputer operates the switch to control the ignition timing of the generator. The microcomputer is in communication with a speed sensor that detects the rotational speed of the engine and a speed limitation control that limits the engine speed to a limitation speed below the clutch-in speed of an included centrifugal clutch. The speed limitation control is active or activated when one of either starting the engine or an operating problem of the power tool is detected. The speed limitation control is deactivated when a low speed state of the engine is detected.

18 Claims, 3 Drawing Sheets

START SAFETY IGNITION SYSTEM

CROSS-REFERENCE TO RELATED APPLICATION

This application is a continuation-in-part patent application of International Application No. PCT/SE2005/001100 filed 1 Jul. 2005, now abandoned, which was published in English pursuant to Article 21(2) of the Patent Cooperation Treaty. Said application is expressly incorporated herein by reference in its entirety.

TECHNICAL FIELD

The present invention relates to a method and arrangement for controlling an ignition system of an internal combustion engine which has a primary firing pulse generator for charging a capacitor and also has an electronic switch for discharging the capacitor via an ignition coil to generate an ignition voltage. A microcomputer operates the switch to control the ignition timing of the generator and the microcomputer is communicatively connected with a speed detector, also referred to as detection means, that directly or indirectly detects the rotational speed of the engine. A speed limitation control is utilized to limit the engine speed to a limitation speed below the clutch-in speed of a centrifugal clutch under certain conditions and circumstances.

BACKGROUND

Multi-purpose portable working machines such as chain saws, cutting tools and grass trimmers that have internal combustion engines are well known. Each of these types of machines has a working tool, such as a chain or cutting blade, which is brought to an operating rotational speed by the included engine. Since the operating tool is often close-by the operator, there is a risk of contact and an accidental injury occurring. Therefore, such machines are often equipped with a mechanical security brake for the tool, together with other security arrangements such as requiring two-hand-grip engagement by the operator in order to affect operation.

The machine is normally equipped with a centrifugal clutch that engages the tool when the engine exceeds a certain rotational speed. In normal operation, the clutch improves safety because the tool does not rotate when the engine speed is reduced below the clutch-in speed. The risk for bodily injury is therefore significantly reduced.

The machine is normally started with the throttle valve positioned in a starting position in order to ensure an efficient start-up. Because of the valve position, more air flows into the motor causing the engine rotational speed to immediately increase above the clutch-in speed of the tool when the engine catches and starts. This can present a risk because the operator will not always be holding the machine in such a way that the security arrangements provide the intended protection. Still further, as the engine speed quickly rises upon starting, the clutch-in speed will be achieved before the operator is ready for the working portion (for example, a chain blade) to begin operation.

In U.S. Pat. No. 4,553,517, an arrangement is described that is intended to work in combination with the centrifugal clutch. The arrangement works in such a way that, simultaneously with the locking of the throttle valve in starting position, a circuit, as part of the ignition system, is activated. The circuit restricts the engine speed to a level below the clutch-in speed of the centrifugal clutch. A switch is deactivated when the throttle valve is no longer in the start position and thereby allows the engine to operate normally.

One problem with this solution is that it operates using a mechanical switch. This means that in case of switch failure, the arrangement will either continuously be in a speed limiting stage or never activate the speed limitation during start-up. Another problem is that the switch, to prevent failure, has to be very reliable and therefore is expensive. A further problem is that the switch cooperates mechanically with the start position knob on the machine and consequently relies on operator manipulation in order to be active during start-up. The switch is activated when activating the start position knob, and if the machine is started with half or wide open throttle valve without activating the knob, the start security system will fail to perform as intended. Still another problem is that the design of each mechanical switch is highly dependent upon the product into which it is being incorporated since the switch must cooperate and coexist with other physical components of the including machine. This means that a special technical design must be used for each product category such as power cutters, chain saws or grass cutters. In view of these drawbacks, an object of the present invention is to solve the above-outlined problems.

SUMMARY OF THE INVENTION

The present invention relates to a method for controlling an ignition system of an internal combustion engine which has a primary firing pulse generator for charging a capacitor and an electronic switch for discharging the capacitor via an ignition coil to generate an ignition voltage. A microcomputer operates the switch to control the ignition timing of the generator. The microcomputer has speed detection means for directly or indirectly detecting the rotational speed of the engine and a speed limitation control to limit the engine speed to a limitation speed below the clutch-in speed of a centrifugal clutch.

In one embodiment of the present invention, the speed limitation control is active or activated when starting the engine and is deactivated when the speed detection means detects a low speed state of the engine and acknowledgment by the operator of the routine's implementation. In a second embodiment of the invention, the speed limitation control initiates when certain operational problems are detected.

DETAILED DESCRIPTION

The figures show an illustrative embodiment of a method for providing a speed limitation control in accordance with the present invention. The illustrative embodiments shall not be interpreted as a limitation of the invention. The purpose is instead to illustrate how the invention can be applied and to further illustrate the scope of the claimed invention.

The illustrative embodiment relates to a microcomputer-controlled method for providing a speed limitation control in the combustion engine ignition system that has a primary firing pulse generator for charging a capacitor and an electronic switch for discharging the capacitor via an ignition coil to generate an ignition voltage. The ignition system also includes a microcomputer that operates the switch to control ignition timing of the generator.

The microcomputer, via the speed detection means, detects the rotational speed of the engine. Within the scope of the invention every speed detection means is considered, including both direct and indirect sensing of the speed of the internal combustion engine. Examples of direct detection or sensing would be the utilization of magnetics or hall-effect sensors for detecting the rotation of the shaft or an electric sensor for detecting the current generated by the primary firing pulse generator. An example of an indirect detection of the rotational speed of the engine would be the detection of the time of ignition in relation to a stroke of the piston. This would be applicable for cases where the engine speed is controlled by varying the time angle of the ignition in relation to the top dead end of the piston.

Figure 2:
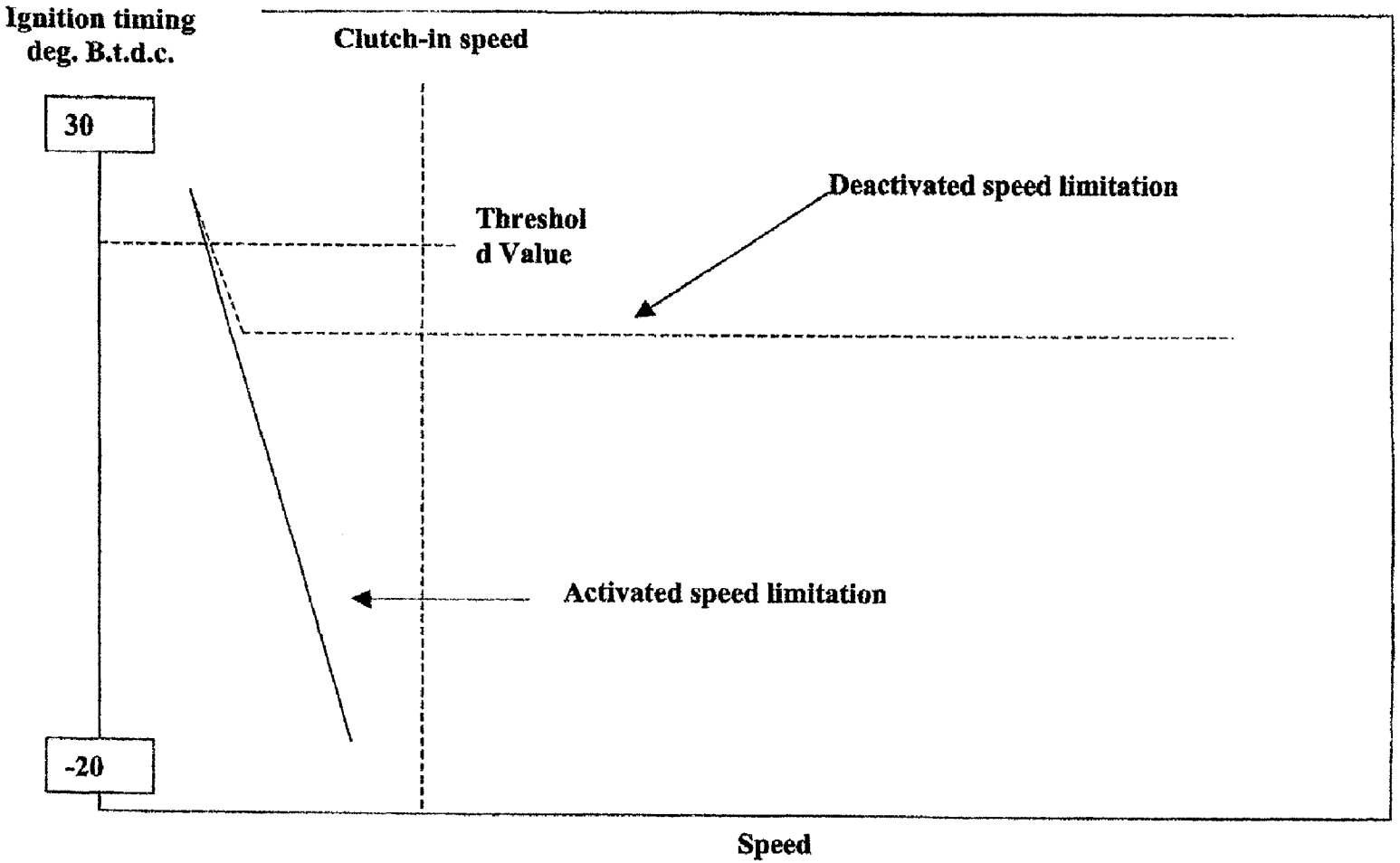
FIG. 2 is a diagram depicting how the time of ignition is controlled in the speed limitation system.

In FIG. 2, it is described how the time angle of ignition relates to the engine's speed. The ignition will come earlier (ignition timing goes up) if the speed goes down to keep the speed as even as possible for a certain throttle position. In cases where the throttle valve is partly open, for instance if a starting knob is activated, the speed will be higher and the ignition will come later (ignition timing goes down). The speed will be kept as even as possible at a higher level due to the partly open valve. Since the speed is related to the ignition angle, the microcomputer can evaluate the angle and determine if the speed has gone down to a level below the clutch-in speed. Such a level corresponds to the low speed state, which will be described further below.

In the illustrative embodiment, the microcomputer embodies the speed limitation control feature. The control assures the limitation of the engine speed to below the clutch-in speed of a centrifugal clutch. The intention is that this control will, when the operator starts the engine, strictly stop any attempt by the engine or the operator to bring up the speed so that the centrifugal clutch powers the cutting tool (working portion) into rotation. An uncontrolled rotation of the cutting tool could be dangerous for the operator, and the speed limitation control avoids the clutch being engaged at start-up.

Figure 1:
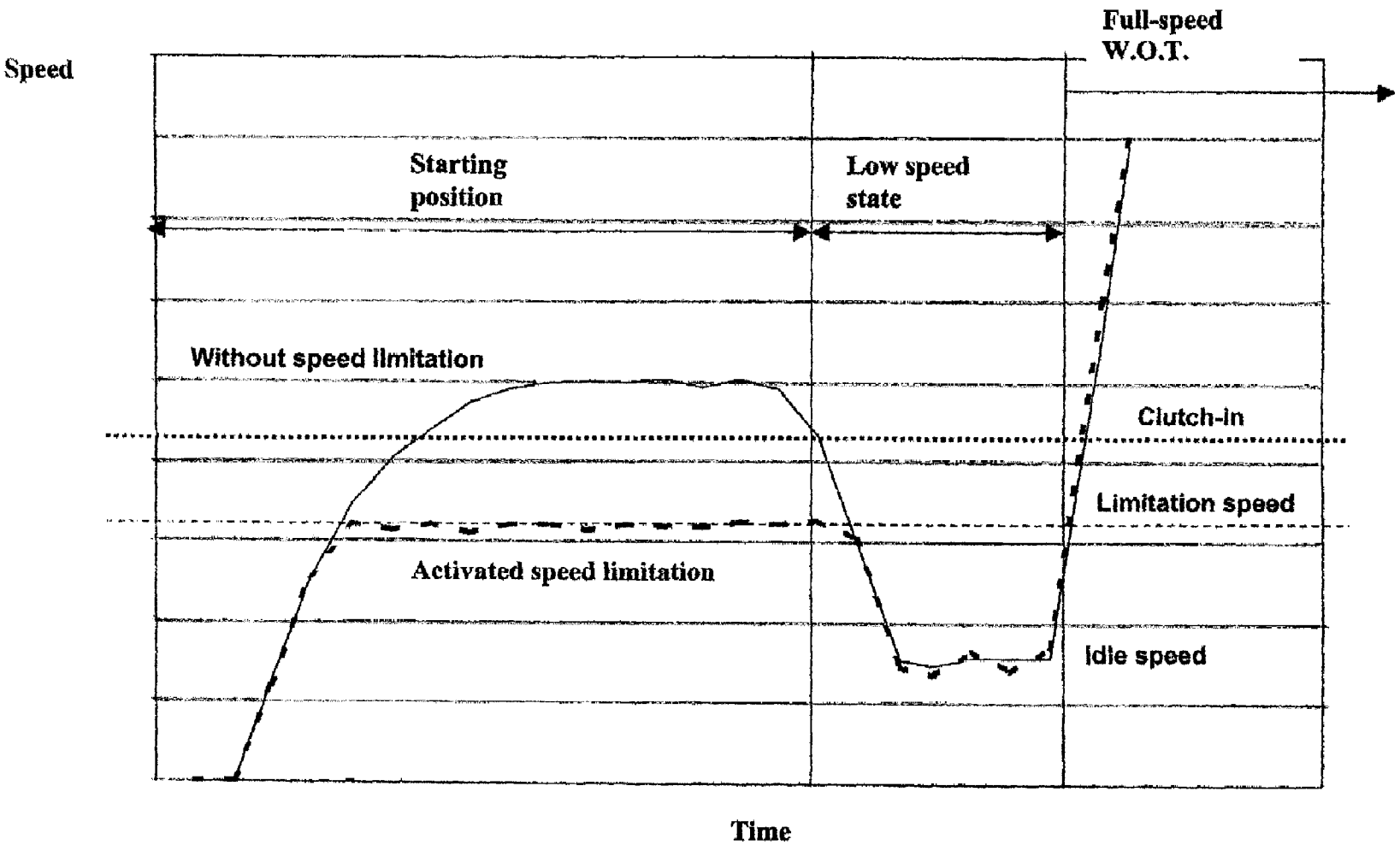
FIG. 1 is a diagram depicting how the method operates at a starting period for the combustion engine.
Figure 3:
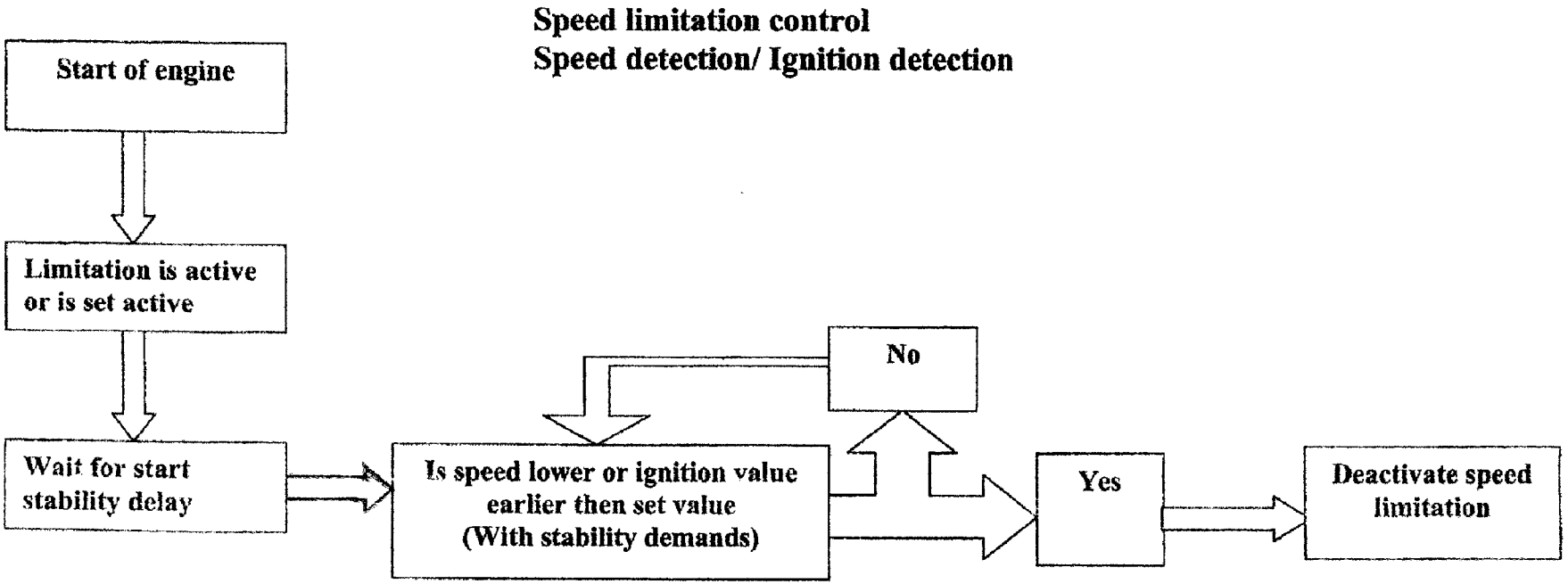
FIG. 3 is a flow chart illustrating how the method operates at a starting period for the combustion engine.

As described herein, a primary aspect of the current invention is to provide a control method in which the engine speed limitation control is active or activated when starting the engine and is deactivated when the speed detection means detects a sufficiently low speed state of the engine as illustrated in FIGS. 1 and 3. This means that when the operator starts the engine, the microcomputer system either immediately or after a short period activates the speed limitation control. Furthermore, if a low speed state is detected which corresponds to an engine speed below the limitation speed, the speed limitation control is deactivated by the microcomputer.

The low speed state corresponds to an operation state of the engine in which the rotational speed of the engine is below the limitation speed. To provide a margin (FIG. 1), the limitation speed is distanced from the clutch-in speed due to possible variations in clutch-in speed. This provides a safer system that better assures keeping below the clutch-in speed even if variations exist.

For most engines this low speed state relates to a throttle valve being in its most closed position. The pre-defined requirement of a low speed state for deactivation means that the operator, after have started the engine, in most cases has to grip the working machine with both hands, thereby being safely away from the cutting tool. Without doing so, he will not be able to deactivate the speed limitation control. This is because he has to press the handle throttle control to deactivate the start position of the throttle valve which brings the speed down to idle level.

In cases where the engine has a direct fuel injection system, there is no throttle valve to define the idle speed level. However, it should be realized by the person skilled in the art that a low speed state for any combustion engine is included within the scope of the invention.

The activation of the speed limitation control will stop any attempt by the engine or the operator to bring up the speed so that the centrifugal clutch brings the cutting tool into rotation. It is only dependent on the starting of the engine and cannot be stopped by the operator. This means that the activation is not related to any requirement except the fact that the engine is being started. The reason for this is to avoid a failure of the speed limitation system. For instance the varying speed at start could, if the activation was dependent on the speed control, result in that there is no activation.

In the context of the present disclosure, starting the engine means any starting, either with choke (cold engine), normal start (warm engine), start with a wide-open throttle or start by pumping the choke. To avoid that some few lost ignitions or a tool that gets stuck will be misunderstood by the microcomputer as a turn-off of the engine, it could be preferable to have a short time period delay at start-up before activating the speed limitation control. This period should be so short that it does not cause any failure of the speed limitation control for a normal start.

The deactivation on the other hand will occur when the engine reaches the low speed state. This means that the microcomputer will detect that the speed goes below the clutch-in speed of the centrifugal clutch. As earlier mentioned, this low speed state also corresponds to an earlier angle time for the ignition, which information can also be used to detect the low speed state.

To have a margin (see FIG. 1) due to possible variations in clutch-in speed, the limitation speed is distanced (below) from the clutch-in speed. This gives a safer system in order to keep out of the clutch-in speed variations. Moreover, the low speed state has to last for a certain time period before the speed limitation control is deactivated. Preferably, the system will create an average of the speed for a period of 30-100 cycles before deactivating. The reason for this is to avoid deactivation by mistake, for instance by speed variations at start due to properties of the air/fuel mixture or if the operator pumping the choke or the handle throttle valve control. It may also be possible to include a time period at the beginning of the start of the engine within which deactivation is not allowed. This adds safety since the engine speed varies substantially at the first cycles of ignition.

The requirement of using an average speed to detect the low speed state means that the operator has to allow the engine to go down to the idle speed for a period of time, which in turn means he will have more control of the machine and probably be safely away from the cutting tool.

In a related aspect, the speed limitation can be implemented when certain operational problems are encountered. A common problem arises when the working portion of the machine is overloaded to the extent that the engine slows under the load. An illustrative example is the chain blade of a chain saw that is being advanced through a tree log too quickly. As the operator presses down on the rotating chain blade too hard, the chain blade slows, dragging the engine speed down with it.

A negative outcome usually develops. As described above, in general, the centrifugal clutch begins to engage and transfer torque when a sufficient initial engine speed is achieved, and which is referred to herein as the clutch-in speed. But as engine speed continues to increase, the clutch continues to engage more and more, permitting less and less relative slip until a fully engaged engine speed is reached. Once the fully engaged speed and clutch configuration is achieved, essentially no relative slip is permitted in the centrifugal clutch and a substantially direct drive connection is affected across the clutch. The speed range beginning with the speed at which initial clutch engagement occurs and continuing until full clutch engagement occurs is referred to as the slip speed range.

As described above, the slip speed range is entered from the lower end at start-up with the engine speed beginning at zero and increasing therefrom. After crossing idle engine speed and the limitation control speed, which is preferably slightly above the idle engine speed, the initial clutch-in speed is reached. During typical operation, the engine's speed continues to increase across the slip speed range until the clutch is fully engaged, and then beyond for high-speed, high-powered machine operation.

As intimated above, however, when the working tool is experiencing overload, the slowing engine enters the slip range speed from the upper end. Even though the engine is slowing under the overwhelming load, full or near full power is normally still being applied by the engine in an effort to urge the working tool back to the faster working speed. However, as the centrifugal clutch enters the slip speed range from the top end, slippage begins to be allowed, but heavy clutch engagement is still being affected. This is a detrimental situation because the permitted high-friction producing clutch slippage generates potentially harmful friction heat. Normally, the rotating tool, such as a binding chain blade, actually stops rotating and all of the engine torque is being dissipated in the centrifugal clutch—which can get damagingly hot. Still further, depending upon the power rating of the engine and the paired clutch, the situation can continue for prolonged periods until the operator becomes aware that clutch slippage is occurring. Because the actual rotation of the working tool is not always visible or otherwise obvious to the operator during operation due to such things as blade covers, flying saw dust and the fact that the working tool can be buried in the material being cut or otherwise worked on, detrimental and damaging operation can continue for long periods causing damage to the machine and potentially threatening the safety of the operator.

Therefore, in another protective aspect of the present disclosure, the engine speed limitation control is affected when it is detected that prolonged operation has occurred in the slip speed range. The clutch's primary purpose is to facilitate run-up of the working tool and engine. It is not intended that prolonged operation will occur in this slip speed range. Therefore, when excessively long operation has been detected in the slip speed range, the limitation control slows the engine to the same or similar speed to which the engine is taken when the engine is being limited during start-up protection as described hereinabove. The amount of generated heat-energy can be substantial; on the order of several kilowatts. At these levels, the generated heat can not only be damaging to the clutch itself, but also to surrounding covers and other nearby components of the machine such as the drive belt, bearings and clutch drum, among others. Therefore, this second protective capacity of the present speed limitation control is highly desirable.

Among other indicators, excessive clutch slip conditions can be sensed and analyzed using the microprocessor to determine whether excessive clutch slip is occurring by counting the number of consecutive engine revolutions that occur in the clutch slip speed range. When the number exceeds a predetermined limit, the engine speed limitation control is initiated and the engine slowed below the clutch-in speed.

Achievement of the reduced engine speed can be affected in different ways. One way is to switch off the ignition for some cycles. This is an easy way but may cause higher emissions at start-up. Another way, which is also demonstrated in FIG. 2, is to control the timing of the ignition. A third way is to use a direct injection system, where the fuel injection is controlled. Any of these three ways will have the effect of an instant speed limitation, which is of course necessary.

In order to provide operator feedback, operator perceivable signals, such as visible or audible signals, can be provided. An example would be indicator lamps; one lamp can be provided to generically indicate that an operating problem exists, or unique indicators can be provided that correlate to the particular cause of the problem or the component to which the problem relates such as the clutch, engine or the like.

Finally, it is important to have the acknowledgment of the operator that it is recognized that speed limitation control has been affected and that the throttle is no longer controlling engine speed. Since the microprocessor control takes engine speed down to a speed approaching idle speed, it is advantageous to require that the operator release the throttle trigger in a manner that would have otherwise also affected idle speed operation of the engine, much as it has been controlled to, independent of the operator. Therefore, in the preferred embodiment, once the engine speed limitation control has been activated, the operator must release the throttle trigger for a resetting period of time after which the limitation control is deactivated and the engine speed can once again be increased for use. Further, it is advantageous to also use this reset procedure when start-up engine speed limitation control is initiated so that the operator becomes accustomed to the routine for deactivating the control and readying the machine for active use.

What is claimed is:

1. A method for controlling an ignition system of an internal combustion engine comprising a primary firing pulse generator for charging a capacitor and an electronic switch for discharging the capacitor via an ignition coil to generate an ignition voltage, a microcomputer operating the switch to control the ignition timing of said generator, said microcomputer in communication with a speed detection means that detects the rotational speed of the engine and a speed limitation control to limit the engine speed to a limitation speed below the clutch-in speed of a centrifugal clutch, wherein the speed limitation control is active or activated when one of (i) starting the engine and (ii) an operating problem of a power tool is detected, and the speed limitation control is deactivated when the speed detection means detects a low speed state of the engine for a defined period.

2. The method as recited in claim 1, wherein the detection of engine speed is made indirectly by detecting the time of ignition in relation to a stroke of the piston.

3. The method as recited in claim 2, wherein the detection of time of ignition is based on the microcomputer's control to operate the engine in a preset value for its rotational speed.

4. The method as recited in claim 3, wherein the preset value is the engine's rotational idle speed.

5. The method as recited in claim 1, wherein the low speed state of the engine corresponds to a rotational speed of the engine below the limitation speed.

6. The method as recited in claim 5, wherein the staff limitation control is deactivated when the low speed state has existed for a defined time period.

7. The method as recited in claim 6, wherein the low speed state of the engine corresponds to a throttle valve being positioned at a most closed position thereof.

8. The method as recited in claim 6, wherein the low speed state corresponds to a time of ignition which is earlier in relation to the top dead center of the piston than a preset threshold value.

9. The method as recited in claim 1, wherein the speed limitation control limits the speed through the operation of said switch via selectively activating or deactivating the ignition at different strokes of the piston.

10. The method as recited in claim 1, wherein the speed limitation control limits the speed through the operation of said switch via selecting the time of ignition in relation to a stroke of the piston.

11. The method as recited in claim 1, wherein the operating problem of the power tool is a centrifugal clutch slip problem which is detected by counting a number of revolutions during which the engine speed is within a slip speed range of the centrifugal clutch and comparing the counted number of revolutions with a compare number, and when the counted number of revolutions reach or pass the compare number, the speed limitation control is activated.

12. The method as recited in claim 11, wherein the compare number is a predetermined first number that is reduced with a predetermined second number when a second activation of the speed limitation occurs within a predetermined number of revolutions and is further reduced if a third activation occurs within the predetermined number of revolutions.

13. The method as recited in claim 1, wherein the operating problem is a centrifugal clutch slip problem and is detected by measuring a temperature in or close to the clutch.

14. The method as recited in claim 1, wherein the operating problem is an overheat problem of the engine or a component of the power tool and is detected by measuring a temperature in or close to the engine or component.

15. The method as recited in claim 1, wherein the hand held power tool is a cut off machine and the operating problem occurs above the end of clutch-in speed of the centrifugal clutch and is a slip problem of its drive belt detected by measuring a rotational speed of the working tool or its shaft and comparing it with the speed of the engine.

16. The method as recited in claim 1, wherein at least one problem indicator lamp is activated when the engine is running at the limitation speed.

17. The method as recited in claim 1, wherein the speed limitation control is also active or activated when starting the engine and being deactivated when said speed detection means detects a low speed state of the engine.

18. The method as recited in claim 16, wherein there is a separate indicator lamp each having a different a color for problems relating to the clutch, engine, and drive belt.

* * * * *